US005681496A

United States Patent [19]

Brownlow et al.

[11] Patent Number: 5,681,496

[45] Date of Patent: Oct. 28, 1997

[54] APPARATUS FOR AND METHOD OF CONTROLLING A MICROWAVE OVEN AND A MICROWAVE OVEN CONTROLLED THEREBY

[75] Inventors: Michael James Brownlow, Oxford; Toshio Nomura, Oxfordshire, both of United Kingdom

[73] Assignee: Sharp Kabushiki Kaisha, Osaka, Japan

[21] Appl. No.: 524,046

[22] Filed: Sep. 6, 1995

[30] Foreign Application Priority Data

Sep. 7, 1994 [GB] United Kingdom ..... 9418052

[51] Int. Cl.[6] ..... H05B 6/68

[52] U.S. Cl. ..... 219/707; 219/482; 219/704; 99/325

[58] Field of Search ..... 219/707, 705, 219/708, 703, 518, 482, 704; 99/325

[56] References Cited

U.S. PATENT DOCUMENTS

| | | | |
|---|---|---|---|
| 4,162,381 | 7/1979 | Buck | 219/707 |
| 4,171,382 | 10/1979 | Buck | 219/707 |
| 4,488,026 | 12/1984 | Tanabe | 219/707 |
| 4,874,928 | 10/1989 | Kasai | 219/492 |
| 5,319,171 | 6/1994 | Tazawa | 219/705 |
| 5,369,253 | 11/1994 | Kuwata et al. | 219/707 |

FOREIGN PATENT DOCUMENTS

| | | | |
|---|---|---|---|
| 0000957 | 3/1979 | European Pat. Off. . | |
| 0023971 | 2/1981 | European Pat. Off. . | |
| 0024798 | 3/1981 | European Pat. Off. . | |
| 0078607 | 5/1983 | European Pat. Off. . | |
| 0397397 | 11/1990 | European Pat. Off. . | |
| 0529644 | 3/1993 | European Pat. Off. . | |
| 0595569 | 5/1994 | European Pat. Off. . | |
| 0615400 | 9/1994 | European Pat. Off. . | |
| 61-265427 | 11/1986 | Japan . | |
| 4292714 | 10/1992 | Japan . | |
| 4-350421 | 12/1992 | Japan | 219/707 |
| 5-172334 | 7/1993 | Japan . | |
| 5-172338 | 7/1993 | Japan . | |
| 5312328 | 11/1993 | Japan . | |
| 2206425 | 1/1989 | United Kingdom . | |

OTHER PUBLICATIONS

Search Report for European Appl. 95306275.9, mailed Oct. 8, 1996.

Search Report for U.K. Appl. 9418052, mailed Dec. 8, 1994.

*Primary Examiner*—Philip H. Leung

[57] ABSTRACT

A sensor based automated cooking apparatus is provided. A humidity sensor measures the moisture content within a cooking cavity. An output of the sensor is provided to a digital filter to remove noise therefrom before being passed to a feature extractor which performs a data compression step and extracts salient features relating to the shape of the humidity versus time characteristic. The parameters are analyzed by a neural network to estimate a degree of doneness of the food. A controller uses the degree of doneness to estimate the remaining cooking time and appropriate power level. The cooking apparatus then operates in an open loop mode for the remainder of the cooking time using the appropriate power level.

19 Claims, 5 Drawing Sheets

APPARATUS FOR AND METHOD OF CONTROLLING A MICROWAVE OVEN AND A MICROWAVE OVEN CONTROLLED THEREBY

FIELD OF THE INVENTION

The present invention relates to an apparatus for and a method of controlling a cooker and to a cooker controlled by such an apparatus. The control apparatus is especially suited for use with a microwave oven.

BACKGROUND OF THE INVENTION

There is a trend towards domestic appliances which offer improved customer convenience by means of intelligent reasoning applied to data derived from sensors within the appliance. An example of this trend is sensor based automated cooking, which is a process of heating or cooking fresh or precooked food which assumes that very little knowledge of how to cook the food will be supplied by the consumer. In order to achieve this, the cooking is controlled by a controller which uses sensors in the cooker to infer the state of the food and to determine optimum cooking or reheating conditions such as power level and cooking time.

As used herein the term "cooking" is understood to include the processes of reheating and drying food.

The optimum cooking conditions are dependent on food related parameters such as food type, weight, initial temperature and water content. The cooking conditions are also dependent on parameters of the cooker, such as heating power and physical state of the cooking cavity. The large number of parameters and the ill-defined nature of the cooking process makes the problem of automated cooking control inherently difficult to solve.

There are three main approaches used for sensor based cooking. In the first approach, the consumer enters data relating to the food type using a control panel. A humidity sensor is used to measure how much steam is given off during heating and once the humidity reaches a predetermined value for the food being heated, a formula is used to calculate the remaining heating time. The formula is generally food specific. Thus the food type entry operation may require a large number of input keys in order to cover a broad range of food types.

An alternative technique is to analyse data from a humidity sensor so as to attempt to identify the type of food being cooked. Once the food has been identified, the cooking can be executed in accordance with a predetermined set of instructions specific to each type of food. However, the class of food types which can be identified using a single humidity sensor may be restricted.

The final technique uses a plurality of sensor types in order to identify the food. The multiple sensor approach is relatively expensive both in terms of cost of the sensors and the complexity of computation required to analyse the data produced by them.

Examples of these techniques are disclosed in Japanese Patent No. 5-312328 Matsushita Denki Co. and in Japanese Laid-open Patent Application No. 4-292714 Sanyo Electric Co. Ltd. In these techniques, neural networks may be used for identifying the food type.

EP 0 615 400 discloses a microwave oven having alcohol and steam sensor for sensing alcohol and steam given off by food during cooking. This information is then used to determine the type of food being cooked.

EP 0 595 569 discloses a microwave oven having sensors for determining the temperature and the volume of gas in the cooking cavity. This information is then used to determine the type of food being cooked.

U.S. Pat. No. 4,162,381 discloses a microwave oven having a relative humidity sensor and a temperature sensor for sensing humidity and temperature within the cooking cavity. Control of cooking is based on the assumption that, for each type of food, there is a characteristic curve of humidity against time which provides the correct cooking cycle. The oven provides closed loop control of the heating process by comparing the measured humidity against time with the characteristic curve and adjusting heating to minimise error. However, the oven must identify or be informed of the type of food in order to provide correct cooking.

Similar techniques are disclosed in EP-0 000 957, EP-0 078 607, EP-0 024 798, EP-0 397 397, EP-0 023 971, and GB-2 206 425.

In reality, new food types are introduced into the market often and ingredients and volumes of existing food types may also change frequently. Thus, the task of classifying food type is difficult to achieve in practice and is inherently "fuzzy" in nature.

SUMMARY OF THE INVENTION

According to a first aspect of the present invention there is provided a cooking apparatus, comprising a cooking region, at least one heating device for heating food within the cooking region, and a humidity sensor for sensing humidity within the cooking region, characterised by a data processor including a trained neural network arranged to make an estimate of doneness without identifying the type of food on the basis of humidity measurements made by the humidity sensor and further arranged to control the at least one heating-device on the basis of the estimate of doneness.

The present invention overcomes the disadvantages of the known techniques by directly deriving an estimate of "doneness" without identifying the type of food being heated. The term "doneness" as used herein is defined to mean a measure of how well the food is cooked so far and may be expressed, for example, by a percentage between 0% and 100%. Thus, rather than attempting to classify the food being heated and then calculating the remaining heating time, it is possible to determine directly the optimum heating time, power level, and, if appropriate, manipulation (e.g. stirring) of food required for the remainder of the cooking process.

Preferably the data processor is arranged to calculate an estimate of doneness at a specific point within the cooking process of the food. The remaining cooking time may then be calculated on the basis of that estimate. The estimate may be made when a rate of change of humidity within the cooking region reaches a peak value.

The neural network may be embodied in dedicated hardware or may be simulated within a programmable data processor. Alternatively, the neural network may be implemented as a look-up table.

The data processor may further be arranged to analyse the humidity data to extract one or more components of a feature vector therefrom prior to making the estimate of doneness. The one or more components of the feature vector may be used as input data to the data processor for estimating doneness.

The one or more components of the feature vector represent shape information of the humidity trajectory (i.e. the level of humidity with respect to time). A first component of the feature vector may indicate the maximum rate of change of humidity with respect to time ($dH_{max}$). A second component of the feature vector may indicate the value of humidity ($H_{dHmax}$) at the maximum rate of change of humidity. A third component of the feature vector may indicate the time ($T_k$) at which the humidity is equal to a fixed threshold ($H_k$). A fourth component of the feature vector may indicate the average humidity ($H^O$) calculated from the start of the heating process up to the time $T_k$.

Preferably the cooking apparatus is a microwave oven. The microwave oven may include a grill and/or a convection-type heating element.

Preferably the humidity sensor is an absolute humidity sensor. The humidity sensor may be positioned within an extraction duct for extracting moist air from the cooking region.

The data processor may be arranged to estimate doneness solely on the basis of the humidity measurements.

According to a second aspect of the present invention, there is provided a method of controlling a cooking apparatus having a cooking region and at least one heating device for heating food within the cooking region, the method comprising making a plurality of measurements of humidity within the cooking region, using the humidity measurements to estimate doneness without identifying the type of food, and controlling the at least one heating device in accordance with the estimate of doneness.

According to a third aspect of the present invention there is provided a control apparatus for controlling a cooking apparatus having a cooking region, at least one heating device and a humidity sensor, the control apparatus comprising a data processor including a trained neural network arranged to make an estimate of doneness without identifying the type of food on the basis of humidity measurements made by the humidity sensor and to control the at least one heating device on the basis of the estimate of doneness.

It has been found that humidity measurements are sufficient to allow the doneness of food heated in a cooking region, such as a microwave oven, to be reliably estimated. Further, it has been found that this estimate of doneness is sufficient to allow heating of food to be reliably completed. It is not necessary for information about the type of food to be supplied or derived during such food heating. Also, it is not necessary for information about the state of food (e.g. whether covered, whether lidded, quantity, initial temperature) to be supplied or derived during such food heating. Although it is possible to provide embodiments in which food type and state may be input by a user, this is not essential and it is possible to provide embodiments in which no such user intervention is required. The data processor does not identify the food type or state but instead directly forms an estimate of doneness. Once this estimate has been formed, heating can be continued by open loop control. During open loop control, heating is not dependent on any input parameters, such as humidity, to the data processor. Instead, the duration, power level and any other heating control parameters are fixed in accordance with the estimate of doneness and the heating cycle continues and is completed independently of measured humidity during the open loop part of the heating cycle. In a simple form, the estimate of doneness is used to determine when to terminate heating. This is contrary to all known techniques which, for instance, require other parameters to be sensed, food type or state to be identified by a user, or food type or state to be derived during heating so as to complete the heating process. User intervention can thus be reduced or eliminated while simplifying and reducing the cost of manufacture of cooking apparatuses.

BRIEF DESCRIPTION OF THE DRAWINGS

The present invention will further be described, by way of example, with reference to the accompanying drawings, in which.

DETAILED DESCRIPTION OF THE PREFERRED EMBODIMENTS

Figure 1:
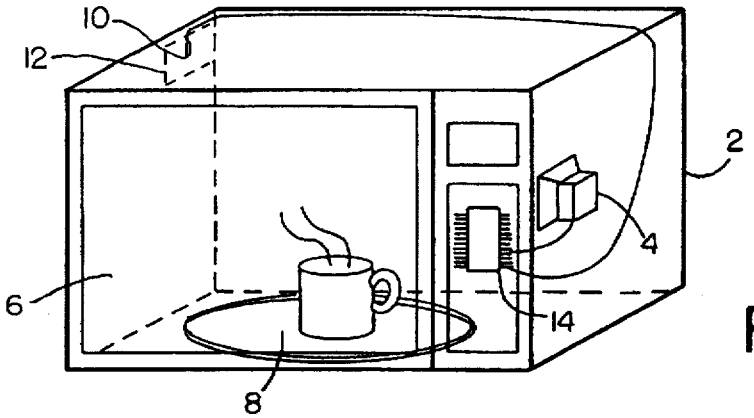
FIG. 1 is a schematic diagram of a microwave oven constituting an embodiment of the present invention.

The microwave oven 2 shown in FIG. 1 has a magnetron 4 for delivering microwave energy into a cooking cavity 6. Although not shown in the drawings, the oven 2 may also comprise other heating devices, such as a grill and a convection-type heating element. The cooking cavity 6 has a turntable 8 therein which rotates during cooking so as to aid even cooking of the food. An absolute humidity sensor 10 is located within an exhaust duct 12. The exhaust duct 12 removes moist air from the cavity 6. A controller 14 receives an output of the humidity sensor 10 and controls operation of the magnetron 4 and of any other heating devices which are present.

Figure 2:
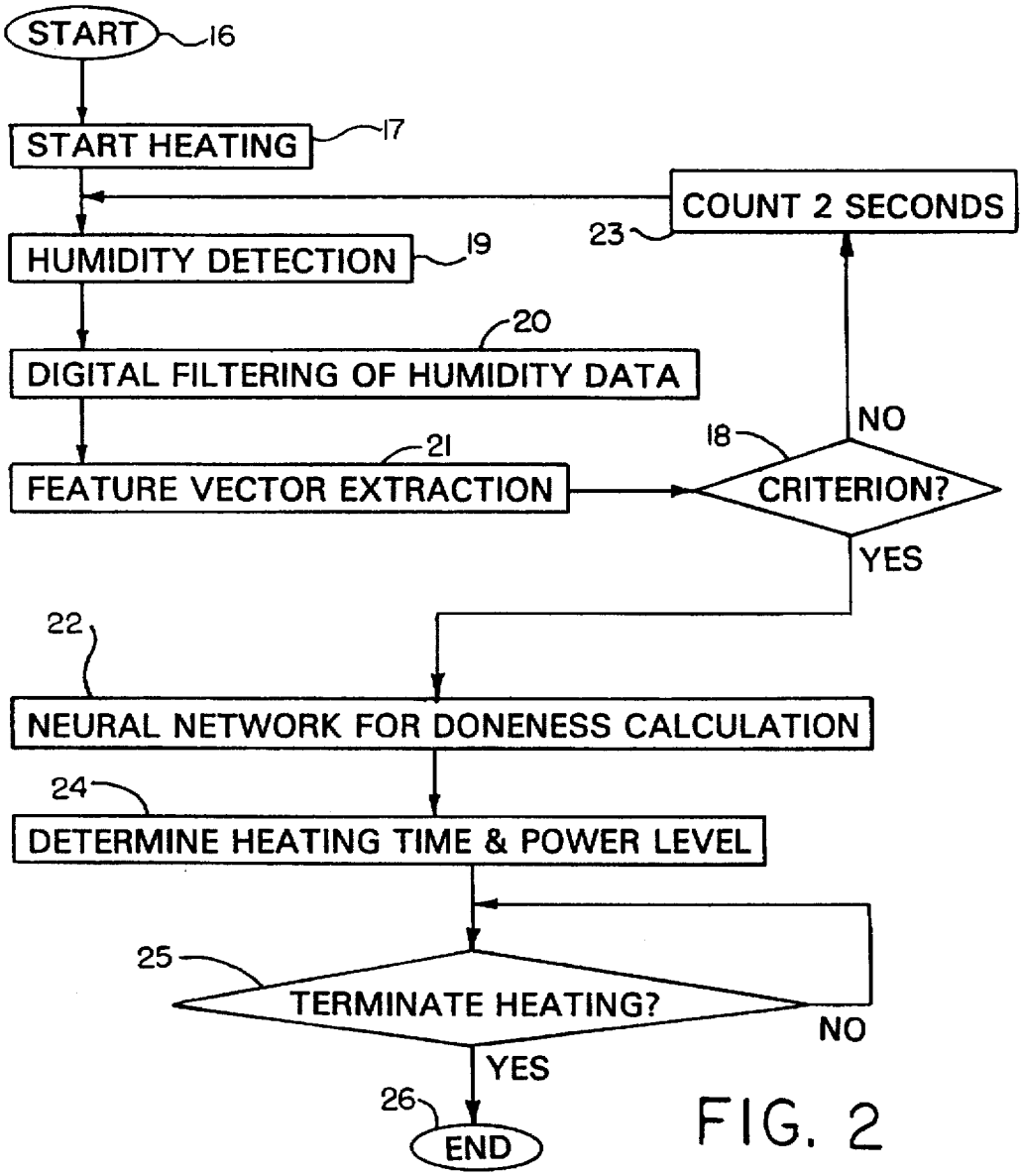
FIG. 2 is a schematic diagram illustrating operation of the microwave oven of FIG. 1.

Operation of the microwave oven 2 under control of the controller 14 is illustrated in FIG. 2. At 16, the cooking process is started in response, for instance, to actuation of a manual control by a user in response to this signal, heating of the food in the oven is started at 17 by energising the magnetron 4 at a predetermined power level, for instance full power, with or without any other heating devices which are present.

The absolute humidity sensor 10 detects the humidity at 19 and supplies the absolute humidity data through a filtering step 20 in which the data are filtered so as to remove noise. The filtered humidity data are then analysed at 21 so as to extract therefrom a plurality of parameters which represent a feature vector of the filtered humidity data. At 18, a test is made as to whether a predetermined criterion has been met. For instance, the criterion may be that the humidity has achieved a predetermined value or that the slope of the humidity becomes a maximum. Then the criterion test 18 indicates that the criterion has not been met, the controller 14 counts for two seconds at 23 before returning control to the step 19. Thus, during an initial phase of operation of the microwave oven 2, the steps 18, 19, 20, 21, 18, and 23 to 23 are repeated while the food within the cooking cavity 6 is heated, the cycle being repeated approximately every two seconds.

When the criterion test 18 indicates that the criterion has been met (for instance a predetermined value of humidity has been reached or the slope of the humidity with respect to time has become a maximum), the feature vector is supplied to a neural network within the controller 14, which neural network calculates a measure of "doneness" of the food at 22. The "doneness" of the food is used at 24 to determine the heating time and power level required to complete the heating or cooking operation. Where the oven has more than one heating device, independent heating times and power levels may be set for the different heating devices. Other food manipulation processes, such as stirring, may also be defined in the step 24. The microwave oven 2 then continues to operate in accordance with the requirements defined in the step 24 until a test step 25 indicates that heating should be terminated, at which time the or each heating device is switched off at 26 and an indication given that the operation of the oven has been completed.

The steps 18 and 20 to 25 are performed by the controller 14 which, apart from embodying a neural network to perform the calculation 22, embodies in hardware and/or software all of the remaining processing steps. Further, suitable interfaces are provided for supplying input data to the controller, for instance from the absolute humidity sensor 10 and a manually operated "start" switch (not shown) and output control signals for controlling the magnetron 4 and any other heating devices which are present.

Figure 3:
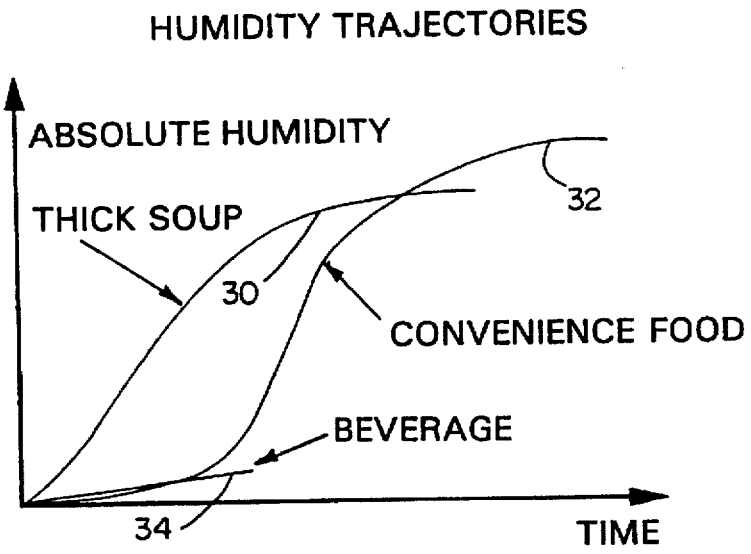
FIG. 3 is a graph illustrating humidity trajectories for different types of food.

When food is heated within a microwave oven, the manner in which it emits steam is dependent on the physical properties of the food and the type of container in which it is situated. A sequence of absolute humidity readings taken as the heating proceeds defines a trajectory of absolute humidity versus time. FIG. 3 shows approximate humidity trajectories of some typical food types. The broad shape of the humidity trajectory can be described as a combination of primitive functions such as linear, sigmoid (i.e. "S" shaped), exponential, etc. The trajectory 30 is characteristic of a thick uncovered liquid, such as soup, which has a rapidly rising humidity which tends to an asymptote. This behaviour is due to edge heating effects which dominate the early emission of steam, followed by conduction effects which allow more of the liquid surface to emit steam. The trajectory 32 is characteristic of pre-packaged convenience foods, rice and pasta. Such a trajectory is approximately sigmoid. The trajectory 34 is characteristic of a low viscosity liquid, such as coffee, which has a relatively linear humidity trajectory until it boils.

In practice there is a considerable overlap between the humidity trajectories of different types of food and this is further modulated by the weight and packaging of a particular food. This overlap makes it difficult to identify a particular food from the humidity trajectory alone. However, it has been realised that shape information of the absolute humidity trajectory can he used to determine the cooking time without explicit identification of the food type. Such a task can conveniently be performed by a trained neural network. Such a neural network can be taught to generalise in an efficient manner shape information for all humidity trajectories.

Figure 4:
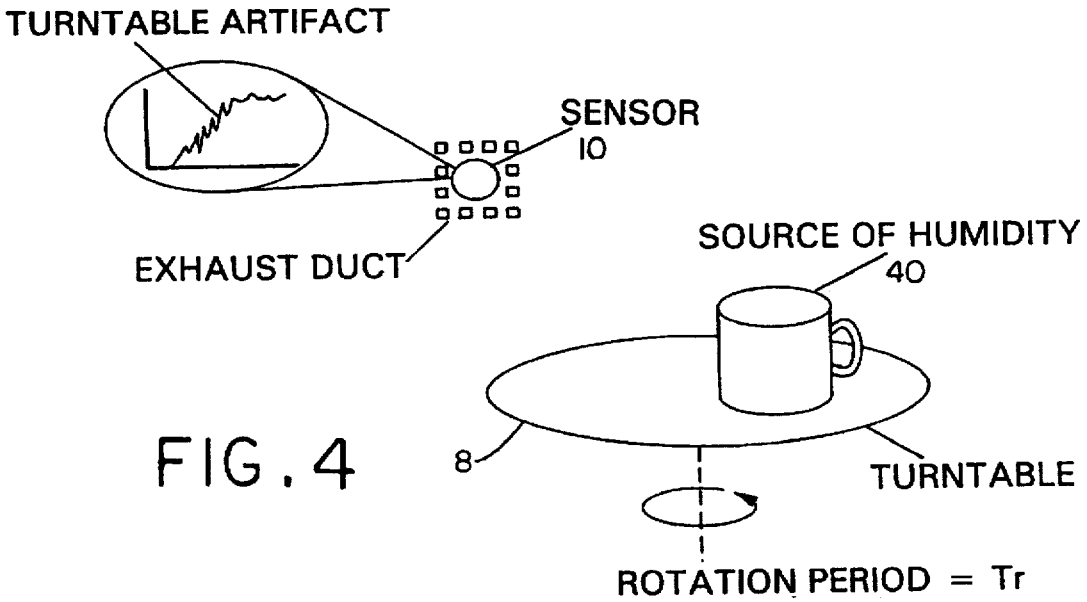
FIG. 4 is a schematic diagram illustrating a source of systematic noise within the humidity measurements.

The inclusion of the turntable 8 can give rise to systematic noise within the humidity measurements. If, as shown in FIG. 4, a source of humidity such as a cup of soup 40, is placed off-centre on the turntable 8, then the distance between the cup of soup 40 and the sensor 10 will vary cyclically with the rotation of the turntable 8. This may result in the output of the sensor 10 having a cyclically varying artifact imposed on the underlying humidity measurement.

Figure 5:
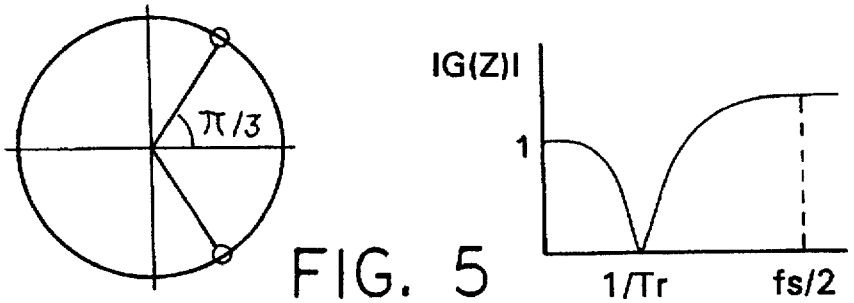
FIG. 5 illustrates a frequency response and Z-domain diagram for a notch filter for removing a systematic error in the humidity measurements due to turntable rotation.

The digital filtering 20 is arranged to remove the cyclically varying artifact due to turntable rotation. The output from the humidity sensor 10 is passed through a finite impulse response (FIR) notch filter. The filter has a complex conjugate pair of zeros on the unit circle in the Z-domain. The angle of the zeros to the positive real axis is $2\pi(f_r/f_s)$, where $f_r$ is the rotation frequency of the turntable and $f_s$ is the frequency at which the sensor data is sampled. A typical value of $f_r$ is 1/12 Hz and a typical value for $f_s$ is ½ Hz. The frequency response of the notch filter and the position of the zeros in the Z-domain are illustrated for the above example in FIG. 5.

The digital filtering 20 is further arranged to remove high frequency noise components using an infinite impulse response (FIR) filter derived from a Butterworth prototype using the bilinear transform. The IIR filter is implemented as a single bi-quadratic section. Such an arrangement introduces little time lag and also avoids excessive phase distortion which would affect the underlying trajectory.

Figure 6:
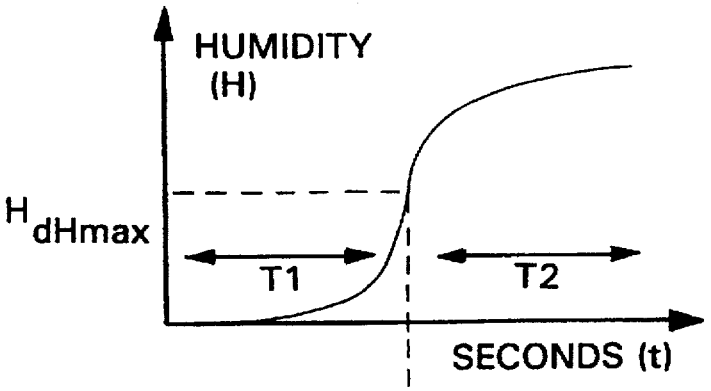
FIG. 6 is an exemplary graph illustrating humidity with respect to time.
Figure 7:
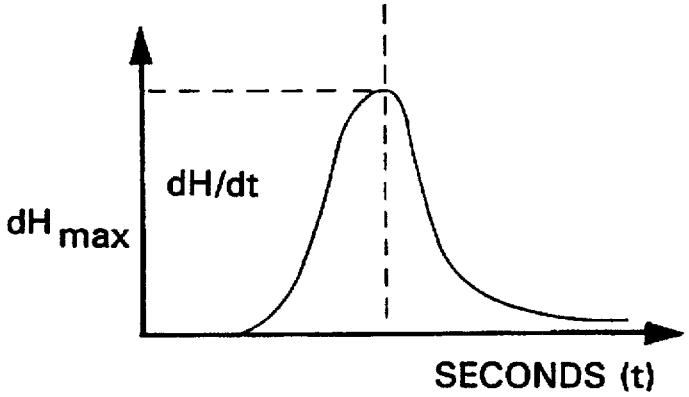
FIG. 7 is a graph illustrating the rate of change of humidity with respect to time for the humidity curve illustrated in FIG. 6.
Figure 8:
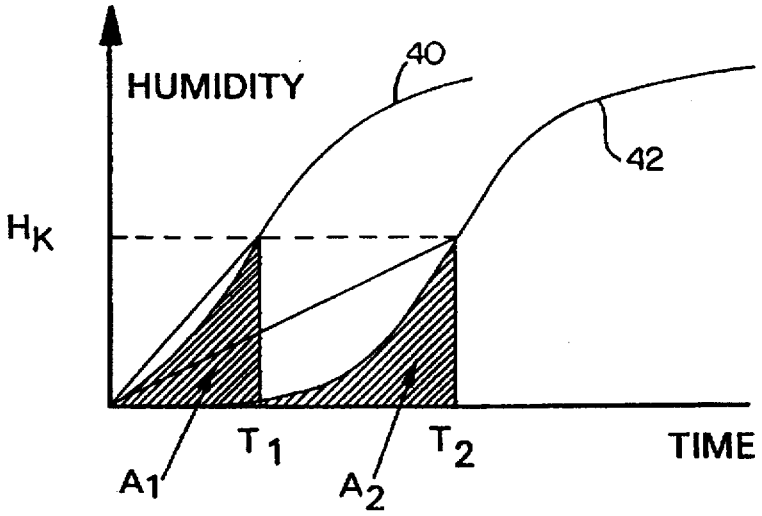
FIG. 8 illustrates the times T1 and T2 for the humidity to reach a predetermined value $H_k$ for first and second humidity curves, and also shows integrated humidities A1 and A2 calculated from the start of the heating process up to the time when the humidity reaches the predetermined value $H_k$ for the first and second curves, respectively.

The filtered humidity data is presented to the feature vector extraction 21 to enable a data compression step to be performed. The humidity trajectory may consist of a large number of real numbers, for example, 100 or more. The humidity trajectory is analysed and is represented by a four component feature vector which summarises the salient characteristics of the humidity trajectory and whose components are calculated as shown in FIGS. 6 to 8.

The humidity trajectory is analysed so as to find the rate of change of humidity with respect to time, dH/dt. The first component of the feature vector is the maximum rate of change of humidity with respect to time $dH_{max}$, as shown in FIG. 7. The corresponding value of humidity $H_{dHmax}$ at the maximum rate of change of humidity is the second component of the feature vector, as shown in FIG. 6. The third component of the feature vector is the time T taken for the humidity to reach a predetermined value $H_k$ as shown in FIG. 8. The fourth component of the feature vector is the average humidity $H^O$ calculated by dividing the integral of humidity by the time taken to reach the predetermined threshold value $H_k$. Thus $H^O$ is calculated from A1 divided by T1 for the first curve 40 in FIG. 8, and by A2 divided by T2 for the second curve 42 in FIG. 8.

Figure 9:
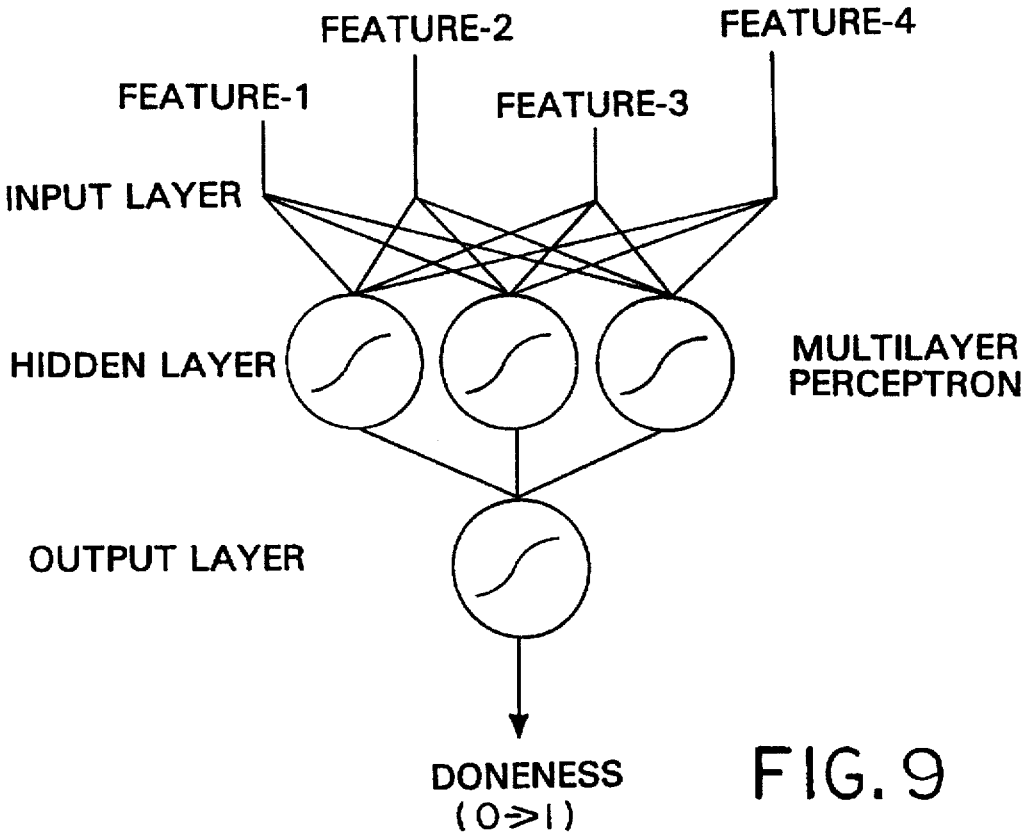
FIG. 9 schematically illustrates a multi-layer perceptron neural network.

A suitable neural network for calculating the doneness from the feature vector at 22 is illustrated in FIG. 9. The neural network is a multilayer perceptron having a 3 layer structure with four input features and one output. Each element within the network performs a weighted summation of its inputs, subtracts a bias and subjects the result to a nonlinear sigmoid function. Neural networks of this type are disclosed by Richard P. Lippmann in "An Introduction of Computing with Neural Nets", IEEE ASSP Magazine, April 1987, pp 4–22.

The output of the hidden layer unit $Y_i$ having N inputs $X_i$ where i ranges from 1 to M, is defined by $$Y_i = f\left(\sum_{i=1}^{i=N} W_{ij}X_i - \theta_j\right)$$

where $W_{ij}$ are real weighting factors, $\theta_i$ is a real bias term and the function f() is a sigmoid threshold function which may be defined according to:

$$f(x) = 1/2\tanh(x+1) = \frac{1}{1+e^{-2x}}$$

although a family of similar functions can also be used. Similarly, the output Z from the second layer of processing units is defined using weighting factors $W'_j$ and a bias term $\theta'$ as follows:

$$Z = f\left(\sum_{j=1}^{j=M} W_jY_j - \theta'\right)$$

where M is the number of units in the hidden layer.

The function of the neural network is to form a nonlinear mapping between the input feature vector and the degree of doneness. Such a neural network is trained using a standard iterative computation procedure called the back propagation algorithm which alters the connection weights $W_{ij}$ and $W'_j$ and the bias $\theta$ and $\theta'$ within the network in order to minimise the mean squared error E between the desired and actual output for the patterns in a training set. Using the notation of the above equations, the error function to be minimised is given by:

$$E = \frac{1}{2}\sum_{p=1}^{p=R}\left[f\left(\sum_{j=1}^{j=M} W_jf\left(\sum_{i=1}^{j=N} W_{ij}X_i(p) - \theta_j\right) - \theta'\right) - t(p)\right]^2$$

where t(p) is the target value for the doneness corresponding to a particular input vector $X(p)=(X_1(p), \ldots, X_n(p))$, p ranges from 1 to R over the training set of feature vectors, and R is the number of patterns in the training set.

Once the error E is sufficiently minimised, the neural network is said to have learnt the desired mapping. In the present case, the neural network learns to associate the humidity trajectories, via the feature vectors, with the desired value of doneness across all the food examples in a training data base.

Each of the above mentioned approaches, e.g., a neural network, or parameters of a trained neural network, or parameters of a trained neural network stored in memory or mapped to a look-up table, can be referred to herein as simulating the functionality of a neural network (i.e., performing a non-linear, multidimensional interpolation between the shape of the humidity versus time curve and doneness.)

Once the neural network has been trained, the weighting factors and bias terms can be stored in memory such that the controller 14 can simulate the neural network. Alternatively, the trained neural network may be mapped into a look-up table. To do this, the components of the feature vector are systematically varied so as to scan a four dimensional input space. The output value of the neural network for each set of input values is recorded in a look-up table. Thus the controller 14 functions as a trained neural network without actually having to simulate such a network.

The process of training the network will now be described.

Figure 10:
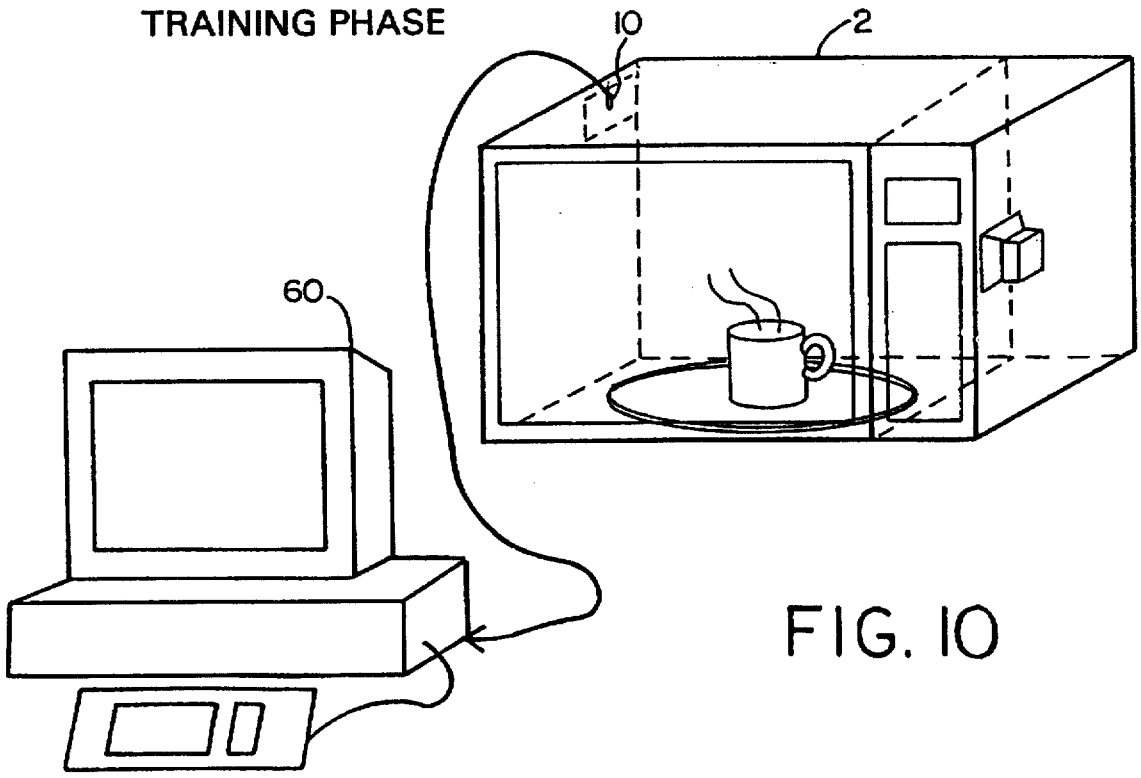
FIG. 10 schematically illustrates an apparatus for training a neural network.

A training apparatus is shown in FIG. 10. The oven shown in FIG. 1 is modified so that the output of the humidity sensor 10 is presented to a computer 60. The computer 60 stores the humidity sensor output as cooking of various items of food progresses. The sensor data is sampled and digitally filtered by the computer so as to define a humidity trajectory for each food item. The optimal cooking time for each food item, $T_{OPT}$ is also estimated by a skilled cook acting in the role of a supervisor to the teaching system.

When the humidity trajectories for the whole cooking or heating processes have been obtained for a wide range of food types, the data preparation phase takes place. Doneness is assessed at a well defined point in the humidity trajectory, for example, at the point at which the maximum rate of change of humidity occurs. The trajectory is then processed in order to extract a set of parameters which describe the humidity trajectory up to the well defined point. These parameters are then saved as feature vectors. The feature vectors represent a data compression step which reduces the computation required by the neural network.

Once the feature vectors have been computed for all patterns in the teaching data base, the neural network training phase begins. The neural network has a number of intermediate non-linear processing units which allow a complex multi-dimensional curve fitting to take place in order to map the feature vectors to the desired doneness value. A number of indices can be used for doneness. For example, it can be defined during the training phase as $$\text{Doneness} = T_k/T_{opt}$$

Thus the doneness represents a percentage estimate of the remaining time, where $T_{OPT}$ is the optimum cooking time and $T_k$ is a stable point in the trajectory, such as the point at which the rate of change of humidity is a maximum or when the humidity reaches a fixed threshold $H_k$. The weights of the network are adjusted in response to all the patterns in the training data base in order to minimise the mean square error between the estimate of doneness produced by the network and the desired doneness given by the above formula.

When the output error on the training database has been minimised sufficiently, network training is terminated and the weights characterising the neural network are downloaded into the memory of an oven controller.

Figure 11:
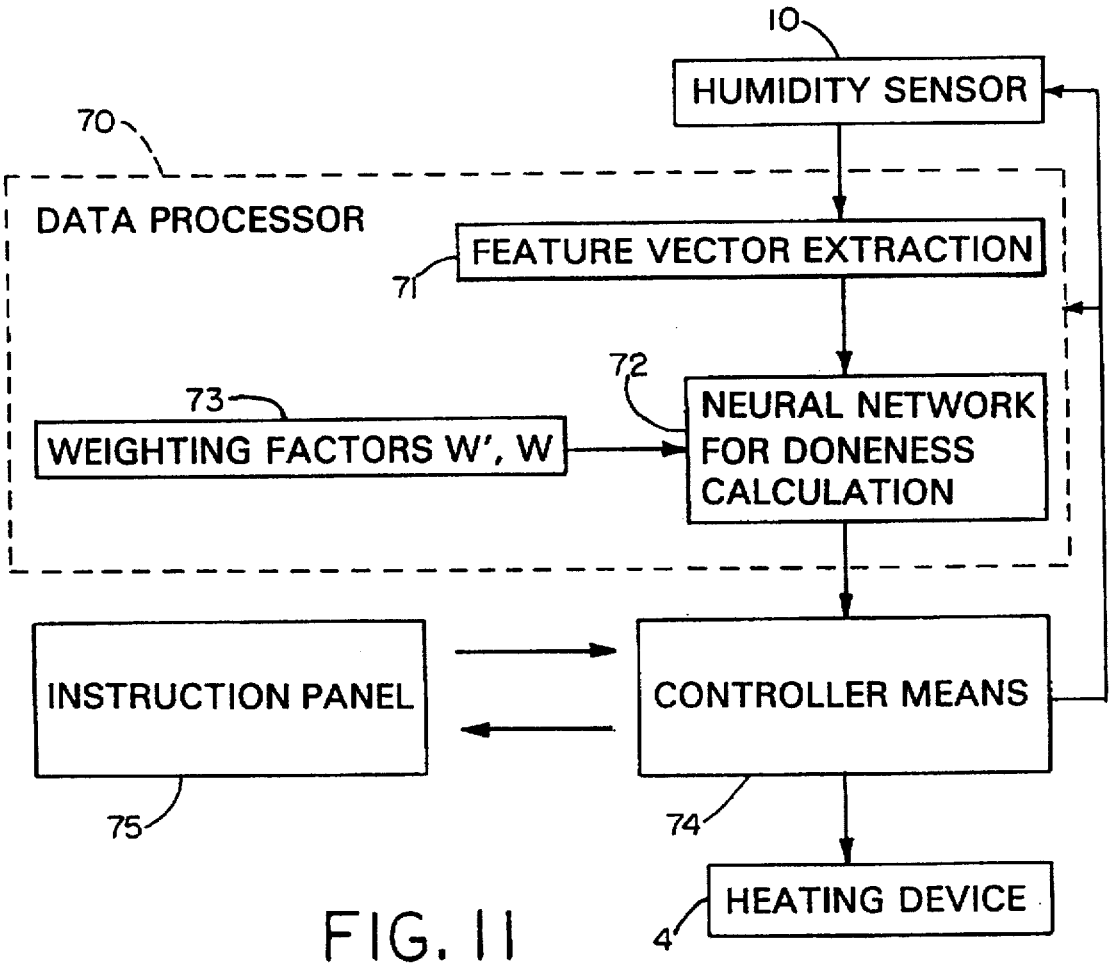
FIG. 11 is a block schematic diagram illustrating a controller of the microwave oven of FIG. 1.

FIG. 11 illustrates an embodiment of the controller 14 connected to the humidity sensor 10 and the heating device 4 in the form of a magnetron. the controller comprises a data processor 70 having an input connected to the humidity sensor 10 via an input interface (not shown). The data processor 70 performs the feature vector extraction step 21 (shown in FIG. 2) as illustrated by the block 71. The feature vector is supplied to a neural network 72 which performs the step 22 of FIG. 2 so as to calculate the doneness of the food. The data processor 70 includes a non-volatile memory 73 which contains various stored parameters, such as the weighting factors W,W' determined during the training process described hereinbefore.

The output of the data processor 70 is connected to controller means 74 which comprises input and output interfaces for controlling operation of the microwave oven. The controller means 74 is connected via a two-way connection to an instruction panel 75 which includes, for instance, a manually operable control for starting operation of the microwave oven and a display for displaying operational information. The controller means 74 contains a suitable output port for controlling the operation and power level of the magnetron 4 and of any other heating device within the microwave oven. The controller means 74 further comprises output interfaces for supplying control signals to the data processor 70 and to the humidity sensor 10.

The controller means 74 is further arranged to calculate the remaining cooking time from the doneness supplied by the neural network 72. As described hereinbefore, the doneness is calculated as $T_k/T_{opt}$ so that the optimum cooking time $T_{opt}$ is calculated in the controller means 74 as $T_k$/doneness. The controller means 74 then calculates the remaining cooking time as $T_{opt}-T_k$ and controls the magnetron 4 and any other heating device appropriately.

In use, the controller 14 of the oven 2 continuously samples the output signal of the absolute humidity sensor. The output signal is filtered and differentiated until some specific time, for example, a maximum rate of change of humidity is detected or the humidity reaches a fixed threshold $H_k$. At this point, the output from the neural network is evaluated so as to obtain a measurement of doneness. The remaining cooking time is estimated from the measurement of doneness and the oven then switches to an open-loop mode and continues to cook/heat the food until the optimum cooking time has elapsed.

During the open loop mode, the average power level of the or each heating device is determined by applying heuristic rules based on the estimated cooking time. Usually the power level is reduced during the open loop mode in order to achieve uniform heating. However, if the remaining time is, for example, less than one minute, the power level may be maintained at the full level.

It is thus possible to provide a controller for a cooking apparatus and a cooking apparatus which can determine the time required to cook food therein without user intervention and without explicit identification of the nature of the food.

What is claimed is:

1. A cooking apparatus, comprising:

a cooking region;

at least one heating device for heating food within the cooking region;

a humidity sensor for sensing humidity within the cooking region, the humidity being varied as a vapor is generated by heating the food;

a processor operatively coupled to an output of the humidity sensor for estimating doneness based on a shape of humidity sensed by the humidity sensor versus time characteristic, said processor simulating the functionality of a neural network; and control means operatively coupled to the at least one heating device for controlling the at least one heating device on the basis of the estimated doneness without knowledge of the nature of the food and without identifying the type of the food.

2. A cooking apparatus as claimed in claim 1, wherein the processor calculates at least one parameter indicative of the shape of humidity versus time characteristic, and estimates the doneness by processing the at least one parameter.

3. A cooking apparatus as claimed in claim 2, wherein the at least one parameter includes a maximum rate of change of humidity, a value of humidity at the maximum rate of change of humidity, a time taken for the humidity to reach a first predetermined value, and an average humidity measured between the start of the cooking process and the time at which the humidity reaches a second predetermined value.

4. A cooking apparatus as claimed in claim 1, wherein the control means calculates a heating time by using the estimated doneness, and controls the at least one heating device on the heating time.

5. A cooking apparatus as claimed in claim 2, wherein the neural network is trained to output the doneness when the at least one parameter is input.

6. A cooking apparatus as claimed in claim 1, wherein the processor estimates the doneness at a specific point during a time in which the food is heated, and the control means calculates the remaining cooking time using the estimated doneness and controls the at least one heating device on the basis of the remaining cooking time.

7. A cooking apparatus as claimed in claim 6, wherein the control means performs an open loop control of the at least one heating device on the basis of the remaining cooking time.

8. A cooking apparatus as claimed in claim 6, wherein the specific point is a point at which a rate of change of humidity within the cooking region reaches a peak value.

9. A cooking apparatus as claimed in claim 1, wherein the at least one heating device comprises a source of microwave energy.

10. A cooking apparatus as claimed in claim 1, wherein the humidity sensor is an absolute humidity sensor.

11. A method of controlling a cooking apparatus having a cooking region and at least one heating device for heating food within the cooking region, comprising the steps of:

sensing the humidity within the cooking region a plurality of times, the humidity being varied as a vapor is generated by heating the food;

estimating doneness based on a shape of humidity versus time characteristic by simulating the functionality of a neural network; and controlling at least one heating device in accordance with the estimated doneness without knowledge of the nature of the food and without identifying the type of the food.

12. A method as claimed in claim 11, wherein the estimating step includes steps of:

calculating at least one parameter indicative of the shape of humidity versus time characteristic; and processing the at least one parameter to obtain the doneness.

13. A method as claimed in claim 12, wherein the at least one parameter includes a maximum rate of change of humidity, a value of humidity at the maximum rate of change of humidity, a time taken for the humidity to reach a first predetermined value, and an average humidity measured between the start of the cooking process and the time at which the humidity reaches a second predetermined value.

14. A method as claimed in claim 11, wherein the controlling step includes steps of:

calculating a heating time by using the estimated doneness; and controlling the at least one heating device on the heating time.

15. A method as claimed in claim 12, wherein the neural network is trained to output the doneness when the at least one parameter is input.

16. A method as claimed in claim 11, wherein the estimating step is performed at a specific point during a time in which the food is heated, and the controlling step includes steps of: calculating the remaining cooking time using the estimated doneness; and controlling the at least one heating device on the basis of the remaining cooking time.

17. A method as claimed in claim 16, wherein the controlling step includes a step of performing an open loop control of the at least one heating device on the basis of the remaining cooking time.

18. A method as claimed in claim 16, wherein the specific point is a point at which a rate of change of humidity within the cooking region reaches a peak value.

19. A cooking apparatus as claimed in claim 11, wherein the humidity sensor is an absolute humidity sensor.

* * * * *

UNITED STATES PATENT AND TRADEMARK OFFICE

CERTIFICATE OF CORRECTION

PATENT NO. : 5,681,496

DATED : October 28, 1997

INVENTOR(S) : Michael James Brownlow et al.

It is certified that error appears in the above-identified patent and that said Letters Patent is hereby corrected as shown below:

Column 4, line 54, change "user in response" to --user. In response--.

Column 6, line 26, change "(FIR)" to --(IIR)--.

Signed and Sealed this

Fourth Day of May, 1999

*Attest:*

*Attesting Officer*

Q. TODD DICKINSON

*Acting Commissioner of Patents and Trademarks*